US012492608B2

(12) United States Patent
Thomas et al.

(10) Patent No.: US 12,492,608 B2
(45) Date of Patent: Dec. 9, 2025

(54) SEALING ELEMENT WITH SLOPED ENDS

(71) Applicant: Halliburton Energy Services, Inc., Houston, TX (US)

(72) Inventors: Reena Thomas, Houston, TX (US); Lonnie Carl Helms, Houston, TX (US); Frank Vinicia Acosta Villarreal, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 23 days.

(21) Appl. No.: 18/145,134

(22) Filed: Dec. 22, 2022

(65) Prior Publication Data

US 2024/0209714 A1 Jun. 27, 2024

(51) Int. Cl.
*E21B 33/12* (2006.01)
*E21B 33/124* (2006.01)
*E21B 33/129* (2006.01)

(52) U.S. Cl.
CPC ..... *E21B 33/1208* (2013.01); *E21B 33/1216* (2013.01); *E21B 33/124* (2013.01); *E21B 33/129* (2013.01)

(58) Field of Classification Search
CPC . E21B 33/1208; E21B 33/1216; F16J 15/021; F16J 15/028
See application file for complete search history.

(56) References Cited

U.S. PATENT DOCUMENTS

| | | | | | |
|---|---|---|---|---|---|
| 823,760 | A * | 6/1906 | Callanan | E21B 33/128 | 277/339 |
| 3,288,222 | A * | 11/1966 | Urbanosky | E21B 33/1208 | 166/134 |
| 4,311,196 | A * | 1/1982 | Beall | E21B 33/129 | 166/134 |
| 4,457,369 | A * | 7/1984 | Henderson | E21B 33/1293 | 166/134 |
| 4,842,082 | A * | 6/1989 | Springer | E21B 23/06 | 175/286 |
| 5,261,492 | A * | 11/1993 | Duell | E21B 23/02 | 166/134 |
| 11,713,640 | B2 * | 8/2023 | Guillory | E21B 33/128 | 166/387 |
| 2009/0151960 | A1 | 6/2009 | Rogers et al. | | |

(Continued)

FOREIGN PATENT DOCUMENTS

| | | | | |
|---|---|---|---|---|
| WO | WO-2014108692 A2 * | 7/2014 | | E21B 33/1208 |
| WO | 2022119576 A1 | 6/2022 | | |

*Primary Examiner* — Blake Michener
(74) *Attorney, Agent, or Firm* — Sheri Higgins Law, PLLC; Sheri Higgins

(57) ABSTRACT

A sealing element for wellbore operations can include an energizing end with a sloped surface and a perpendicular surface, a stationary end with a sloped surface and a perpendicular surface, and an engagement surface located between the energizing end and the stationary end. An energizing sleeve can include a sloped surface that engages with and moves along the sloped surface of the energizing end to cause the engagement surface to engage with the inside of a tool housing, casing, or tubing string to create a seal. A stationary tool component can about the stationary end, so the sealing element is energized. The sealing element can be used in a packer assembly, as an anchoring device, in lieu of O-rings, to allow opening or closing of flow ports, or in other downhole tools.

19 Claims, 6 Drawing Sheets

(56) References Cited

U.S. PATENT DOCUMENTS

| | | | | |
|---|---|---|---|---|
| 2011/0048744 | A1* | 3/2011 | Conner | E21B 33/1216 166/134 |
| 2011/0259610 | A1* | 10/2011 | Shkurti | E21B 33/12 166/318 |
| 2012/0133098 | A1* | 5/2012 | Farquhar | E21B 33/1216 277/336 |
| 2015/0292296 | A1 | 10/2015 | Ezell et al. | |
| 2018/0298716 | A1* | 10/2018 | Cayson | E21B 33/1293 |
| 2018/0320473 | A1* | 11/2018 | Xu | E21B 33/128 |
| 2018/0328136 | A1* | 11/2018 | Smith | E21B 33/129 |
| 2019/0128089 | A1* | 5/2019 | Guerra | E21B 33/1216 |
| 2020/0115990 | A1* | 4/2020 | Patsy | E21B 33/1291 |

* cited by examiner

SEALING ELEMENT WITH SLOPED ENDS

TECHNICAL FIELD

The field relates to sealing elements used in oil and gas operations. The sealing element includes a sloped, energizing end and a sloped stationary end. An energizing sleeve with a corresponding sloped surface is used to energize the sealing element to create a seal.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION

Figure 1A:
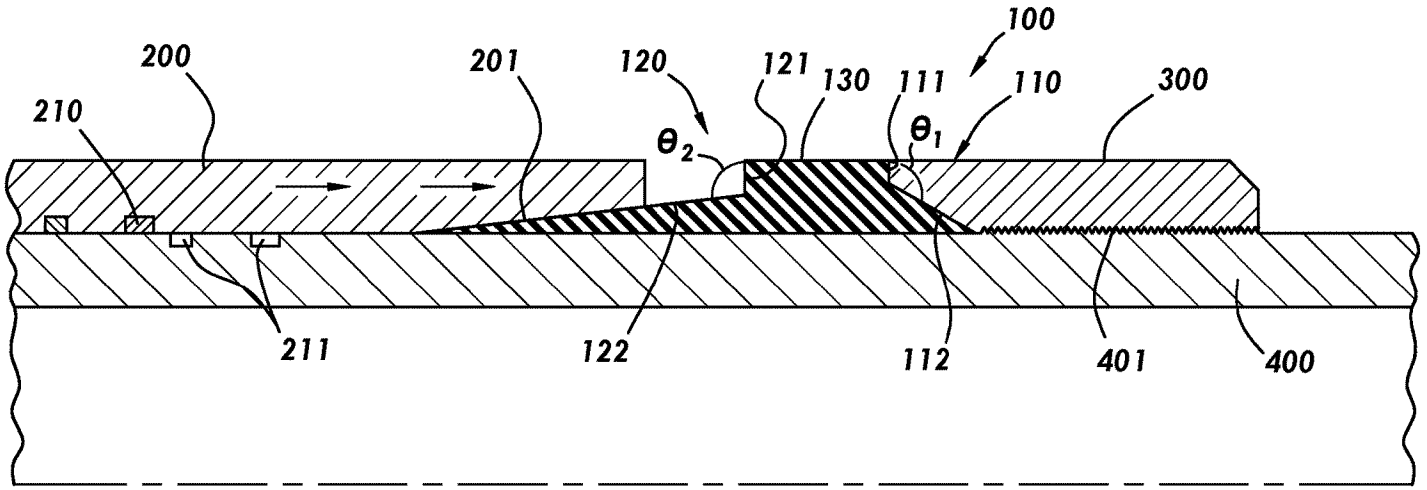
FIG. 1A is a cross-sectional view of a sealing element with a sloped energizing end being located underneath a sloped surface of an energizing sleeve prior to energizing the sealing element according to certain embodiments.

Oil and gas hydrocarbons are naturally occurring in some subterranean formations. In the oil and gas industry, a subterranean formation containing oil and/or gas is referred to as a reservoir. A reservoir can be located under land or offshore. Reservoirs are typically located in the range of a few hundred feet (shallow reservoirs) to a few tens of thousands of feet (ultra-deep reservoirs). In order to produce oil or gas, a wellbore is drilled into a reservoir or adjacent to a reservoir. The oil, gas, or water produced from a reservoir is called a reservoir fluid.

As used herein, a "fluid" is a substance having a continuous phase that can flow and conform to the outline of its container when the substance is tested at a temperature of 71° F. (22° C.) and a pressure of one atmosphere "atm" (0.1 megapascals "MPa"). A fluid can be a liquid or gas. A homogenous fluid has only one phase; whereas a heterogeneous fluid has more than one distinct phase. A colloid is an example of a heterogeneous fluid. A heterogeneous fluid can be a slurry, which includes a continuous liquid phase and undissolved solid particles as the dispersed phase; an emulsion, which includes a continuous liquid phase and at least one dispersed phase of immiscible liquid droplets; a foam, which includes a continuous liquid phase and a gas as the dispersed phase; or a mist, which includes a continuous gas phase and liquid droplets as the dispersed phase. As used herein, the term "base fluid" means the solvent of a solution or the continuous phase of a heterogeneous fluid and is the liquid that is in the greatest percentage by volume of a treatment fluid.

A well can include, without limitation, an oil, gas, or water production well, an injection well, or a geothermal well. As used herein, a "well" includes at least one wellbore. A wellbore can include vertical, inclined, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered to be the region within approximately 100 feet radially of the wellbore. As used herein, "into a subterranean formation" means and includes into any portion of the well, including into the wellbore, into the near-wellbore region via the wellbore, or into the subterranean formation via the wellbore.

A wellbore is formed using a drill bit. A drill string can be used to aid the drill bit in drilling through the subterranean formation to form the wellbore. The drill string can include a drilling pipe. During drilling operations, a drilling fluid, sometimes referred to as a drilling mud, may be circulated downwardly through the drilling pipe, and back up the annulus between the wellbore and the outside of the drilling pipe. The drilling fluid performs various functions, such as cooling the drill bit, maintaining the desired pressure in the well, and carrying drill cuttings upwardly through the annulus between the wellbore and the drilling pipe.

A portion of a wellbore can be an open hole or cased hole. In an open-hole wellbore portion, a tubing string can be placed into the wellbore. The tubing string allows fluids to be introduced into or flowed from a remote portion of the wellbore. In a cased-hole wellbore portion, a casing is placed into the wellbore that can also contain a tubing string. A wellbore can contain an annulus. Examples of an annulus include but are not limited to the space between the wellbore and the outside of a tubing string in an open-hole wellbore; the space between the wellbore and the outside of a casing in a cased-hole wellbore; and the space between the inside of a casing and the outside of a tubing string in a cased-hole wellbore.

There are a variety of oil and gas operations that require a seal to be made. By way of a first example, packer assemblies include a sealing element that can form a seal within an annulus located between the outside of the packer assembly and the inside of a casing or tubing string or wall of a wellbore. The packer assembly can be used to isolate one subterranean formation zone from another. By way of another example, there are a variety of downhole tools that utilize internal sealing elements, such as O-rings, that prevent fluid flow past the sealing element, which can allow pressure to be increased above the tool. Such internal sealing elements can be used for sliding sleeves as part of a valve assembly or for sliding sleeves to open and/or close fluid flow ports. By way of another example, anchoring devices can include a sealing element that aids in anchoring the anchoring device to an inside of a casing or tubing string by providing an annular seal for the anchoring device.

Current sealing elements used in oil and gas operations typically include ends that are perpendicular to a longitudinal axis of the wellbore or downhole tool and have a shape much like a donut. However, due to this shape, it may be difficult to adequately seal when there are tight tolerances at the location of the sealing element. Moreover, there are variances in the inner diameter (I.D.) of a casing or tubing string or outer housings for downhole tools—oftentimes having a difference of 1/16 inch or more spanning across the sealing element. Thus, these inner diameters are not consistent nor uniform and create challenges in obtaining an adequate seal. Thus, there is a need for improved sealing elements that solve the problems discussed above.

It has been discovered that sealing element can include a sloped energizing end and a sloped stationary end with an engagement portion being located between the ends. An energizing sleeve can include a sloped surface that corresponds to the sloped energizing end to energize the sealing element to create a seal. The sealing element can be used in areas where tight tolerances are present, to replace O-rings, and can create a better seal than current sealing element designs—especially due to variances in the I.D. of casing or tubing strings or downhole tools.

A sealing element for wellbore operations can include: an energizing end comprising a sloped surface; a stationary end comprising a sloped surface; and an engagement surface located between the energizing end and the stationary end, wherein the sloped surface of the energizing end is configured to engage with a sloped surface of an energizing sleeve to energize the sealing element to create a seal via the engagement surface.

A method of creating a seal in a wellbore can include: positioning a downhole tool at a location within the wellbore, the downhole tool comprising: an inner mandrel; and the sealing element located circumferentially around the inner mandrel; and causing or allowing a sloped surface of an energizing sleeve to engage with the sloped surface of the energizing end, wherein after engagement, the engagement surface of the sealing element moves radially away from the inner mandrel to create the seal in the wellbore.

It is to be understood that the discussion of any of the embodiments regarding the sealing element is intended to apply to all of the apparatus, system, and method embodiments without the need to repeat the various embodiments throughout. Any reference to the unit "gallons" means U.S. gallons.

Figure 1B:
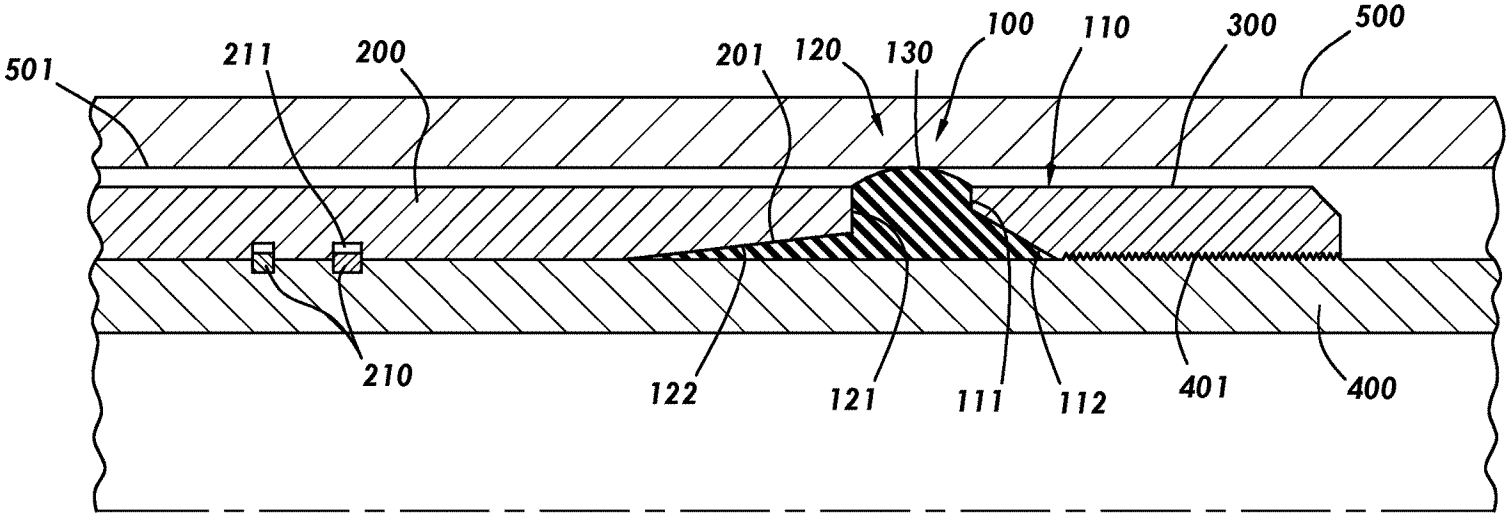
FIG. 1B is a cross-sectional view of FIG. 1A showing the sealing element after being energized.

Turning to the figures, FIGS. 1A and 1B are cross-sectional views of a sealing element 100 according to any of the embodiments. The sealing element 100 can be positioned around an outside of a mandrel 400 and include an inner diameter (I.D.) and an outer diameter (O.D.). The sealing element 100 includes an energizing end 120. The energizing end 120 includes a sloped surface 122. The energizing end 120 can also include a perpendicular surface 121. The perpendicular surface 121 can be perpendicular to a longitudinal axis of the mandrel 400.

Figure 2A:
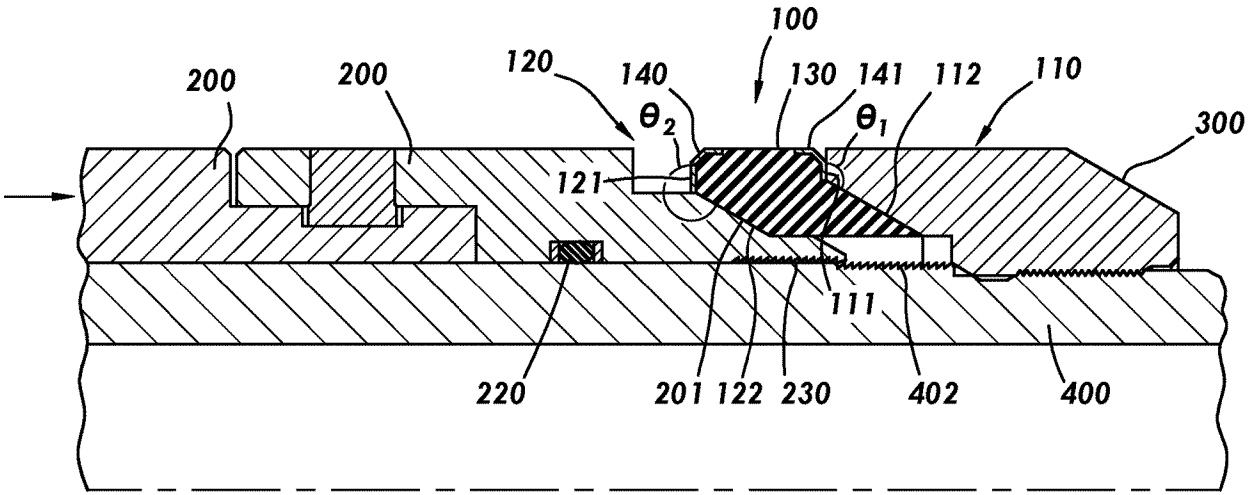
FIG. 2A is a cross-sectional view of a sealing element with a sloped energizing end being located above a sloped surface of an energizing sleeve prior to energizing the sealing element according to certain other embodiments.
Figure 2B:
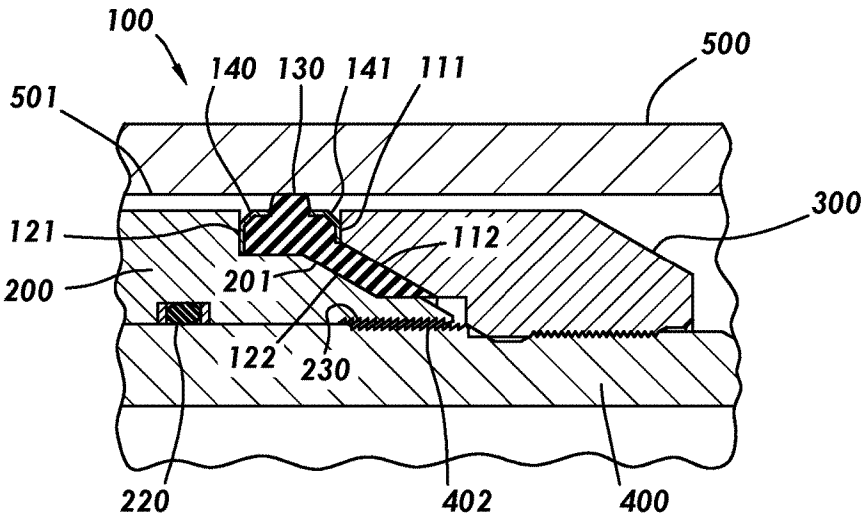
FIG. 2B is a cross-sectional view of FIG. 2A showing the sealing element after being energized.

The sealing element 100 also includes a stationary end 110. The stationary end 110 includes a sloped surface 112. The stationary end 110 can also include a perpendicular surface 111. The perpendicular surface 111 can be perpendicular to a longitudinal axis of the mandrel 400. As used herein with reference to the perpendicular surfaces 111/121, "perpendicular" means some portion or the entire portion of the surfaces are 90° to the longitudinal axis of the mandrel 400 and can include a curvature at the top of the sealing element 100, for example as shown in FIGS. 2A and 2B. As used herein, the terms "top" and "bottom" are for reference purposes only, wherein the top of the sealing element is considered part of the engagement surface 130 and the bottom of the sealing element is located adjacent to the mandrel 400. It is to be understood that in a vertical view as opposed to a horizontal view, the top is to the right and the bottom is to the left.

The sealing element 100 also includes the engagement surface 130 that is located between the energizing end 120 and the stationary end 110. The engagement surface 130 can have a variety of lengths as measured from the perpendicular surface 121 and the perpendicular surface 111 if included or between the energizing end 120 and the stationary end 110. Lengths of the engagement surface 130 can range, for example, from 1 to 1.5 inches. The sealing element 100 can also have a thickness as measured by subtracting the inner diameter from the outer diameter and dividing by 2 ((O.D.−I.D.)/2) in the range of 1 to 1.125 inches.

The stationary end 110 of the sealing element 100 can abut a stationary tool component 300, such as a stationary sleeve or mule shoe. The stationary tool component 300 can be attached to an outside of the mandrel 400 via threads 401, an adhesive, or other type of fastener (e.g., shear pins, lock rings, or ratchets). The stationary tool component 300 can prevent movement of the stationary end 110 of the sealing element 100 during setting.

The sloped surface 122 of the energizing end 120 can be configured to engage with a sloped surface 201 of an energizing sleeve 200. As can be seen in the figures, the sloped surface 122 and the perpendicular surface 121 of the energizing end 120 can form an angle $\theta_2$. The sloped surface 112 and the perpendicular surface 111 of the stationary end 110 can form an angle $\theta_1$. According to any of the embodiments and as shown in FIGS. 1A, 1B, 5A, and 5B, the angle $\theta_2$ can be in the range of 100° to 160° for example, such that the sloped surface 122 of the energizing end 120 extends away from the engagement surface 130 and the stationary end 110 along the mandrel 400. According to any of the embodiments and as shown in FIGS. 2A, 2B, 3, and 4, the angle $\theta_2$ can be in the range of 200° to 280° for example, such that the sloped surface 122 of the energizing end 120 extends underneath the engagement surface 130 towards the stationary end 110 along the mandrel 400. The sloped surface 201 of the energizing sleeve 200 can be configured to match the angle $\theta_2$ such that the sloped surface 201 can engage with the sloped surface 122 of the energizing end 120 of the sealing element 100.

An abutment end of the stationary tool component 300 can be configured to match the angle $\theta_1$ of the sloped surface 112 of the stationary end 110. As can be seen by way of example, angle $\theta_1$ can range from 100° to 160° and extend away from the engagement surface 130 and the energizing end 120 along the mandrel 400. The matching slopes can help prevent movement of the stationary end 110 of the sealing element 100 during setting.

As can be seen in FIGS. 2A-4, the sealing element 100 can include one or more sets of support shoes 140/141. Each of the sets of support shoes 140/141 can be located at a top of the sealing element 100 and be located partially or wholly along the perpendicular surface 121 and perpendicular surface 111 and can also extend partially—not wholly—along the engagement surface 130. The sets of support shoes 140/141 can be made of a semi-flexible, malleable, or rigid material, such as steel or brass. The sets of support shoes 140/141 can be used to prevent swabbing during run-in to keep the sealing element 100 from extruding radially away from the mandrel 400. During setting, the sets of support shoes 140/141 can also allow the engagement surface 130 to become energized and move radially away from the mandrel 400 instead of moving in lateral directions parallel to a longitudinal axis of the mandrel 400. The sealing element 100 as shown in FIGS. 1A and 1B, for example, can also include a set of support shoes (not shown). A set of support shoes may not be needed for the embodiments shown in FIGS. 5A and 5B because the sealing element 100 is not prone to swabbing during run-in due to the protection from components of the downhole tool.

Methods of creating a seal in a wellbore can include positioning a downhole tool at a location within the wellbore. The downhole tool can include the mandrel 400 and the sealing element 100. As shown by way of example in FIGS. 1A-4, the downhole tool can be a packer assembly. According to these embodiments, after setting, the engagement surface 130 of the sealing element 100 is energized and can engage with an inner diameter 501 of a casing or tubing string 500. One of the many advantages of the sealing element 100 for use with a packer assembly is that it can be used inside casing or tubing strings 500 with tight tolerances, and it can create a better seal when variances in the inner diameter 501 exist compared to traditional packer elements that are typically donut shaped.

Figure 5A:
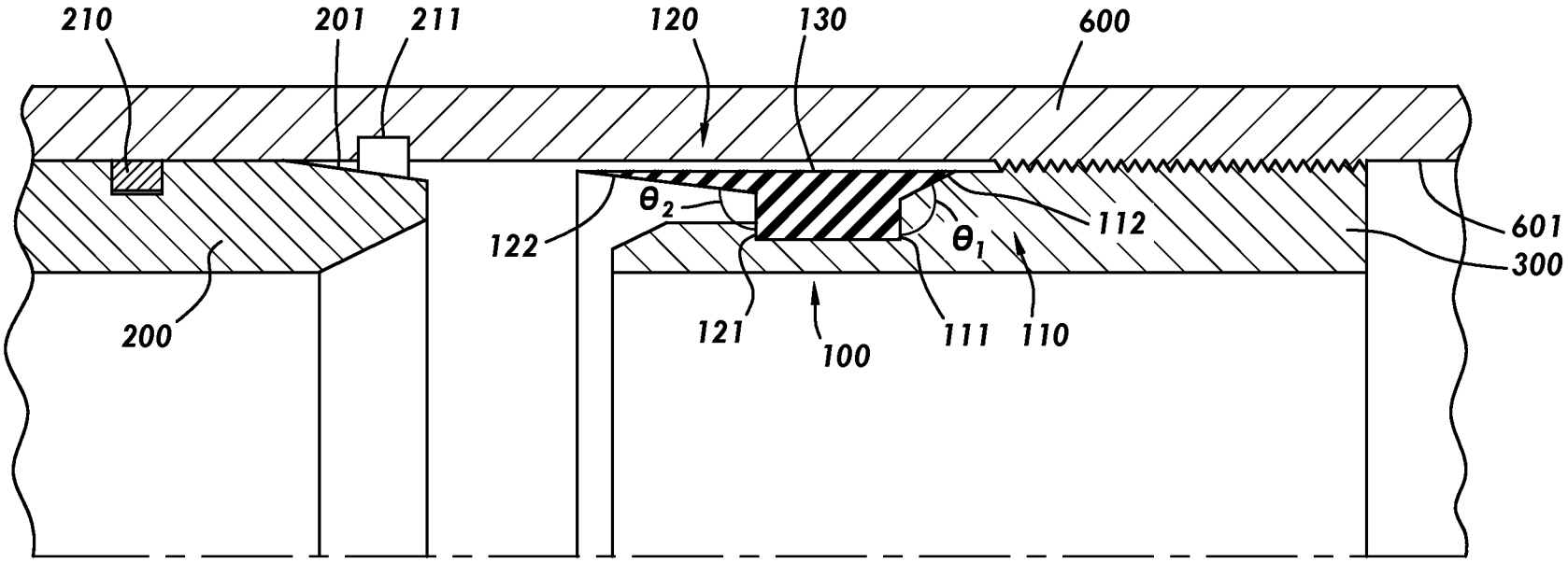
FIG. 5A is a cross-sectional view of a sealing element with the sloped energizing end being located above the sloped surface of the energizing sleeve prior to energizing the sealing element according to certain other embodiments.
Figure 5B:
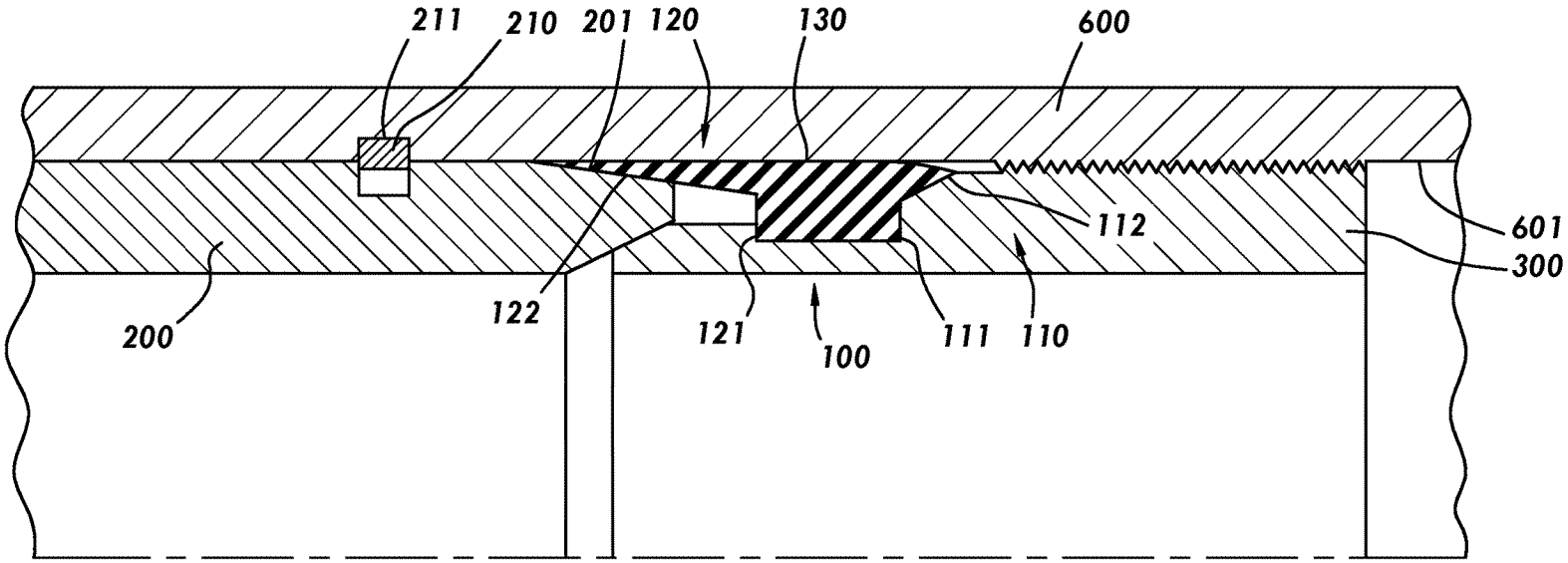
FIG. 5B is a cross-sectional view of FIG. 5A showing the sealing element after being energized.
Figure 6:
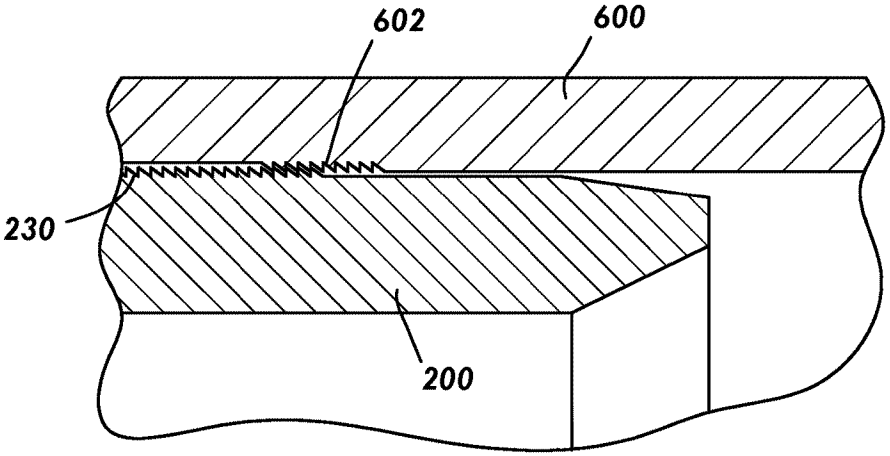
FIG. 6 is a cross-sectional view of the sealing element showing a ratchet system instead of lock rings according to certain other embodiments.

As shown by way of another example in FIGS. 5A-6, the downhole tool can be used in a cementing operation, wherein the sealing element 100 engages with an inner diameter 601 of a tool housing 600 and creates a seal between a body of the tool and the inside of the tool housing 600. Accordingly, the sealing element 100 can be used to create an internal seal in the downhole tool. The sealing element 100 can be used in lieu of O-rings, used to open or close flow ports, or used as an anchoring device. The downhole tool can include other components, such as plug seat (not shown) to increase pressure above the plug seat to pressure test casing, or to cause a sliding sleeve, opening sleeve, or closing sleeve to shift. As an anchoring device, the sealing element 100 can be used in lieu of castellations to keep sleeves from rotating during cementing operations or drilling out operations.

The methods can include causing or allowing the sloped surface 201 of the energizing sleeve 200 to engage with the sloped surface 122 of the energizing end 120. According to any of the embodiments, movement of the energizing sleeve 200 can be accomplished by mechanical or hydraulic actuation of the sleeve. With reference to FIGS. 1A and 1B, during setting of the sealing element 100 after the downhole tool has been positioned within the wellbore, the energizing sleeve 200 can move towards the perpendicular surface 121 of the energizing end 120 of the sealing element 100 to abut the perpendicular surface 121. As the energizing sleeve 200 moves towards the perpendicular surface 121, the sloped surface 201 moves along and ramps up the sloped surface 122 of the energizing end 120. During movement of the energizing sleeve 200 on top of the sloped surface 122, the stationary end 110 prevents the sealing element 100 from moving along the mandrel 400. Continued movement of the energizing sleeve 200 after abutting the perpendicular surface 121 causes the engagement surface 130 to become energized and expand radially away from the mandrel 400 and engage with the inner diameter 501 of the casing or tubing string 500. The length of the tapered portion of the energizing end 120 can be selected such that the sloped surface 201 of the energizing sleeve 200 pushes down on the tapered portion and forces the sealing element to be pushed out away from the mandrel 400 to cause the engagement surface 130 to create a seal against the inner diameter 501 of the casing or tubing string 500. The length of the tapered portion can also be selected to maintain the engagement surface 130 of the sealing element 100 with the inner diameter 501 of the casing or tubing string 500 as shown in FIGS. 1A and 1B or the inner diameter 601 of the tool housing 600 as shown in FIGS. 5A and 5B. Accordingly, FIG. 1A shows the downhole tool in the run-in position (i.e., during positioning of the downhole tool within the wellbore), and FIG. 1B shows the sealing element 100 after setting to create the seal.

With reference to FIGS. 2A and 2B, during setting of the sealing element 100 after the downhole tool has been positioned within the wellbore, the energizing sleeve 200 can move towards the perpendicular surface 121 of the energizing end 120 of the sealing element 100 to abut the perpendicular surface 121. As the energizing sleeve 200 moves towards the perpendicular surface 121, the sloped surface 201 moves underneath the sloped surface 122 of the energizing end 120. During movement of the energizing sleeve 200 underneath the sloped surface 122, the stationary end 110 prevents the sealing element 100 from moving along the mandrel 400. Continued movement of the energizing sleeve 200 underneath the sloped surface 122 causes the engagement surface 130 to become energized and expand radially away from the mandrel 400 and engage with the inner diameter 501 of the casing or tubing string 500 until the energizing sleeve 200 abuts the perpendicular surface 121 of the energizing end 120 as shown in FIG. 2B. Accordingly, FIG. 2A shows the downhole tool in the run-in position, and FIG. 2B shows the sealing element 100 after setting to create the seal.

With reference to FIGS. 5A and 5B, during setting of the sealing element 100 after the downhole tool has been positioned within the wellbore, the energizing sleeve 200 can move towards the perpendicular surface 121 of the energizing end 120 of the sealing element 100 to abut the perpendicular surface 121. As the energizing sleeve 200 moves towards the perpendicular surface 121, the sloped surface 201 moves underneath the sloped surface 122 of the energizing end 120. During movement of the energizing sleeve 200 underneath the sloped surface 122, the stationary end 110 prevents the sealing element 100 from moving along the mandrel 400. Continued movement of the energizing sleeve 200 underneath the sloped surface 122 causes the engagement surface 130 to become energized and expand radially away from the mandrel 400 and engage with the inner diameter 601 of the tool housing 600 until the energizing sleeve 200 abuts the perpendicular surface 121 of the energizing end 120 as shown in FIG. 5B. Accordingly, FIG. 5A shows the downhole tool in the run-in position, and FIG. 5B shows the sealing element 100 after setting to create the seal.

The downhole tool can include a system to prevent the energizing sleeve 200 from moving back away from the energizing end 120 during or after setting—commonly called backlash. By way of a first example and as shown in FIGS. 1A, 1B, 5A, and 5B, the energizing sleeve 200 can include one or more lock rings 210. The mandrel 400 or the tool housing 600 can include one or more lock ring grooves 211. During setting and movement of the energizing sleeve 200 towards the energizing end 120, the lock rings 210 can move towards the lock ring grooves 211. When the lock rings 210 align with the lock ring grooves 211, the lock rings 210 can fit within the grooves to lock the energizing sleeve 200 at its current location and prevent backlash.

By way of a second example and as shown in FIGS. 2A, 2B, 3, 4, and 6 a ratcheting system can be used instead of or in addition to lock rings. A portion of the energizing sleeve 200 located adjacent to the mandrel 400 or tool housing 600 can include sleeve ratchets 230. A portion of the mandrel 400 can include mandrel ratchets 402 or a portion of the tool housing 600 can include housing ratchets 602. As the energizing sleeve 200 is moved towards the energizing end 120 of the sealing element 100 during setting, the sleeve ratchets 230 can engage with the mandrel ratchets 402 or the housing ratchets 602 in incremental steps. When the sleeve ratchets 230 are engaged with the mandrel ratchets 402 or the housing ratchets 602, then the energizing sleeve 200 is locked at its current location and backlash is prevented.

Lock rings 210 and lock ring grooves 211 may be used when it is highly probable or certain that the energizing sleeve 200 will travel a sufficient distance towards the energizing end 120 such that the lock rings 210 lock within the desired lock ring groove 211. By way of example, if there are two lock ring grooves 211 positioned some distance between each other, it may be necessary for a lock ring to lock within the lock ring groove located closest to the perpendicular surface 121. The ratcheting system may be used if it is possible a lock ring may not travel to the desired lock ring groove. The ratcheting system can be more advantageous to use because the ratchets can have small increments between each ratchet, for example, 1/32 of an inch or less to provide minimum backlash. The lock rings and lock ring grooves or the ratcheting system can also help ensure that the energizing sleeve 200 keeps the sealing element 100 extended away from the mandrel 400 and the integrity of the seal created is maintained.

Figure 3:
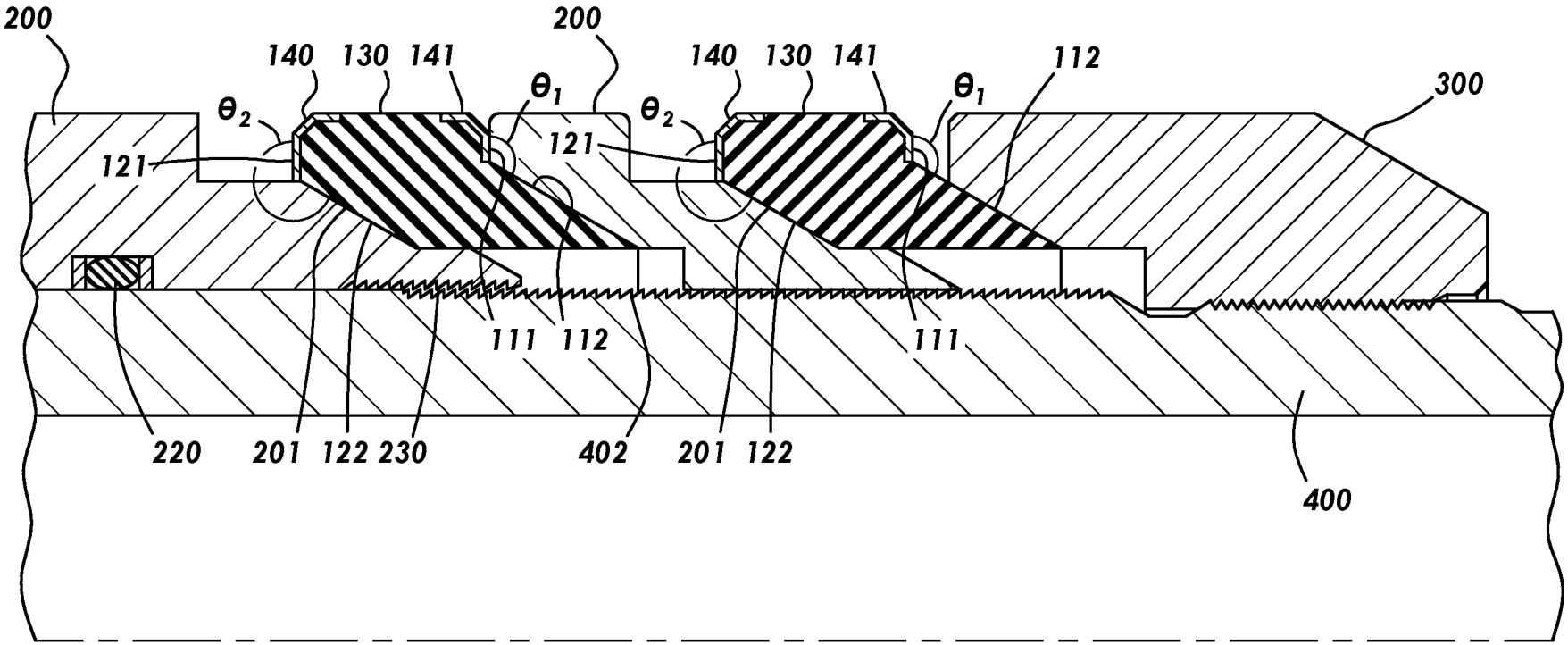
FIG. 3 is a cross-sectional view of FIG. 2A showing more than one sealing element according to certain other embodiments.
Figure 4:
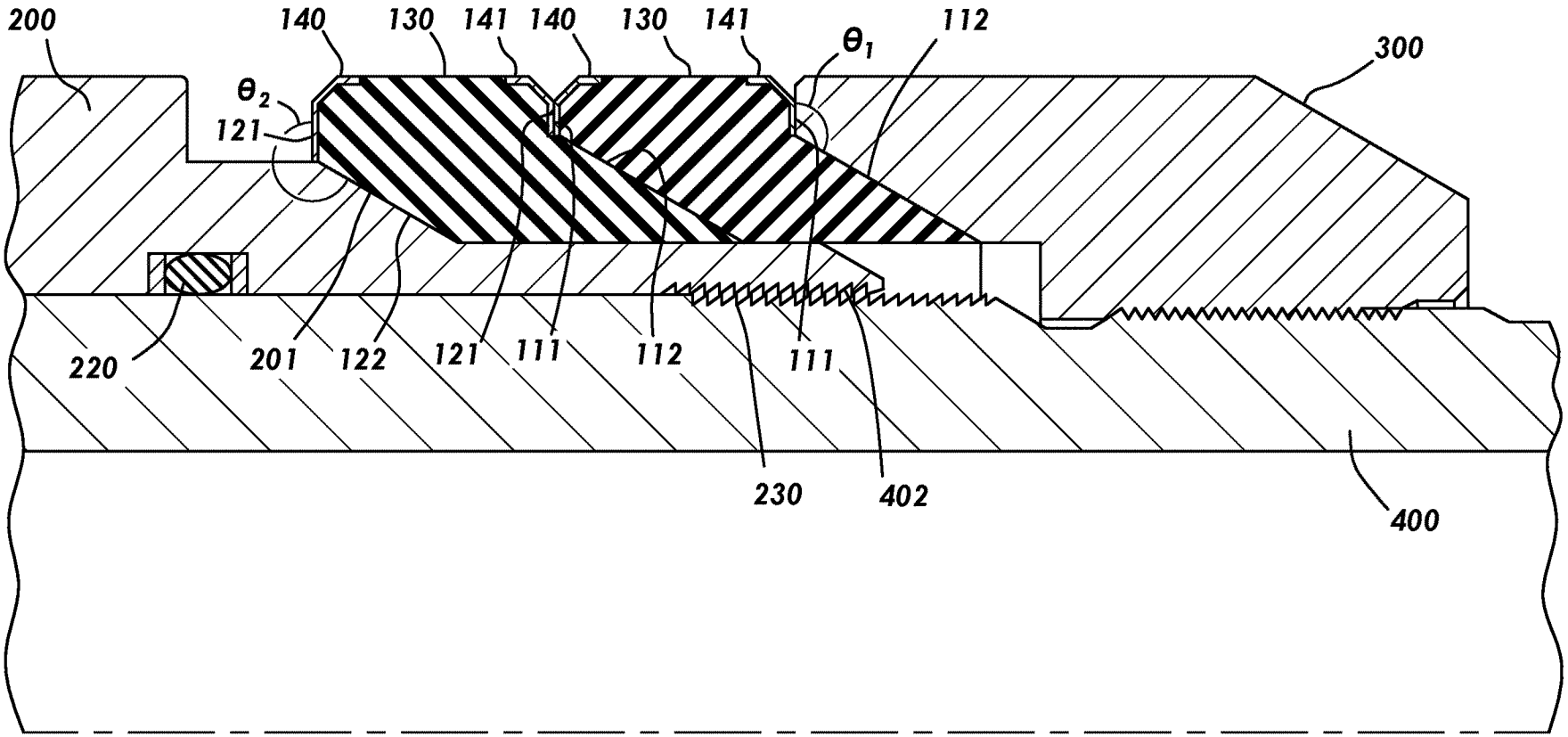
FIG. 4 is a cross-sectional view of FIG. 2A showing more than one sealing element located next to each other according to certain other embodiments.

As shown in FIGS. 3 and 4, the downhole tool can include more than one sealing element 100. A first energizing sleeve 200 can be located adjacent to the energizing end 120 of a first sealing element 100. As shown in FIG. 3, a second energizing sleeve 200 can be located between the stationary end 110 of the first sealing element 100 and the energizing end 120 of a second sealing element. According to these embodiments, each of the first and second energizing sleeves 200 can include sleeve ratchets 230 located adjacent to the mandrel 400. The mandrel ratchets 402 can traverse a desired distance such that the sleeve ratchets 230 of both energizing sleeves 200 are capable of ratcheting up along the mandrel during setting of the sealing elements 100. According to other embodiments and as shown in FIG. 4, each of the sealing elements 100 can be positioned next to each other without an intervening energizing sleeve 200. Although shown with two sealing elements 100, it is to be understood that more than two sealing elements can be used with or without intervening energizing sleeves 200. In practice, setting of the sealing elements 100 can include causing or allowing the sloped surface 201 of the energizing sleeve(s) 200 to energize each sealing element.

The downhole tool can include other components, such as but not exclusively limited to, one or more O-rings 220. The methods can further include other steps such as performing an oil and gas operation after setting of the sealing element.

As discussed above, the sealing element 100 can be used in a variety of downhole tools and oil and gas operations. The sealing element can also be used to seal an annulus for injection of an adhesive into the annulus. By way of example, some downhole tool components can be attached to other tool components or to the inside of a casing or tubing string via an adhesive that forms a bond between the components within the annulus instead of threads. An example of such a downhole tool is a float assembly wherein the float collar body can be bonded to the inside of a casing string via an adhesive that is injected into an annulus between the outside of the tool body and the inside of the casing string.

The sealing element 100 can be made from a variety of materials. According to any of the embodiments, the sealing element 100 is not made from a thermally expanding material or a swellable material, and instead, relies on actuation of the energizing sleeve 200 to cause the material to move or expand radially away from the mandrel 400 during setting. Such materials can broadly be called elastomeric materials. Examples of suitable materials for the sealing element include but are not limited to elastic polymers commonly called elastomers, rubbers, nitrile rubbers, or fluoroelastomers.

An embodiment of the present disclosure is a sealing element for wellbore operations comprising: an energizing end comprising a sloped surface and a perpendicular surface; a stationary end comprising a sloped surface and a perpendicular surface; and an engagement surface located between the energizing end and the stationary end, wherein the sloped surface of the energizing end is configured to engage with a sloped surface of an energizing sleeve to energize the sealing element to create a seal via the engagement surface. Optionally, the stationary end of the sealing element is configured to abut a stationary tool component. Optionally, the stationary tool component prevents movement of the stationary end of the sealing element during setting. Optionally, the stationary tool component is a stationary sleeve or mule shoe. Optionally, the sloped surface and the perpendicular surface of the energizing end forms an angle. Optionally, the angle is in the range of 100° to 160°. Optionally, the angle is in the range of 200° to 280°. Optionally, the sloped surface of the energizing sleeve is configured to match the angle. Optionally, the sloped surface and the perpendicular surface of the stationary end forms an angle. Optionally, the angle is in the range from 100° to 160°. Optionally, the sealing element further comprises a set of support shoes located partially or wholly along the perpendicular surface of the energizing end and the perpendicular surface of the stationary end. Optionally, the sealing element is part of a packer assembly or an anchoring device. Optionally, the engagement surface engages with an inner diameter of a tool housing and creates a seal within the inside of the tool housing. Optionally, the energizing sleeve further comprises one or more lock rings configured to lock within one or more lock ring grooves located on a mandrel or tool housing. Optionally, the energizing sleeve further comprises ratchets configured to engage with ratchets located on a mandrel or tool housing. Optionally, the sealing element is made from elastomers, rubbers, nitrile rubbers, or fluoroelastomers. Optionally, two or more additional sealing elements are located adjacent to the sealing element.

Another embodiment of the present disclosure is a method of creating a seal in a wellbore comprising: positioning a downhole tool at a location within the wellbore, the downhole tool comprising: an inner mandrel; and a sealing element located circumferentially around the inner mandrel, wherein the sealing element comprises: an energizing end comprising a sloped surface and a perpendicular surface; a stationary end comprising a sloped surface and a perpendicular surface; and an engagement surface located between the energizing end and the stationary end; and causing or allowing a sloped surface of an energizing sleeve to engage with the sloped surface of the energizing end, wherein after engagement, the engagement surface of the sealing element moves radially away from the inner mandrel to create the seal in the wellbore. Optionally, the engagement surface creates the seal between the outside of the inner mandrel and the inside of a casing string or tubing string. Optionally, the engagement surface creates the seal between the outside of the inner mandrel and the inside of a tool housing. Optionally, the stationary end of the sealing element is configured to abut a stationary tool component. Optionally, the stationary tool component prevents movement of the stationary end of the sealing element during setting. Optionally, the stationary tool component is a stationary sleeve or mule shoe. Optionally, the sloped surface and the perpendicular surface of the energizing end forms an angle. Optionally, the angle is in the range of 100° to 160°. Optionally, the angle is in the range of 200° to 280°. Optionally, the sloped surface of the energizing sleeve is configured to match the angle. Optionally, the sloped surface and the perpendicular surface of the stationary end forms an angle. Optionally, the angle is in the range from 100° to 160°. Optionally, the sealing element further comprises a set of support shoes located partially or wholly along the perpendicular surface of the energizing end and the perpendicular surface of the stationary end. Optionally, the sealing element is part of a packer assembly or an anchoring device. Optionally, the engagement surface engages with an inner diameter of a tool housing and creates a seal within the inside of the tool housing. Optionally, the energizing sleeve further comprises one or more lock rings configured to lock within one or more lock ring grooves located on a mandrel or tool housing. Optionally, the energizing sleeve further comprises ratchets configured to engage with ratchets located on a mandrel or tool housing. Optionally, the sealing element is made from elastomers, rubbers, nitrile rubbers, or fluoroelastomers. Optionally, two or more additional sealing elements are located adjacent to the sealing element.

Therefore, the apparatus, methods, and systems of the present disclosure are well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present disclosure.

As used herein, the words "comprise," "have," "include," and all grammatical variations thereof are each intended to have an open, non-limiting meaning that does not exclude additional elements or steps. While compositions, systems, and methods are described in terms of "comprising," "containing," or "including" various components or steps, the compositions, systems, and methods also can "consist essentially of" or "consist of" the various components and steps. It should also be understood that, as used herein, "first," "second," and "third," are assigned arbitrarily and are merely intended to differentiate between two or more fluids, valves, etc., as the case may be, and does not indicate any sequence. Furthermore, it is to be understood that the mere use of the word "first" does not require that there be any "second," and the mere use of the word "second" does not require that there be any "third," etc.

Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A sealing assembly for wellbore operations comprising:
only one sealing element comprising:
an energizing end comprising a sloped surface and a perpendicular surface,
wherein the sloped surface is located radially inside of the perpendicular surface;
a stationary end comprising a sloped surface and a perpendicular surface; and
an engagement surface located between the energizing end and the stationary end;
an energizing sleeve comprising a sloped surface and a perpendicular surface; and
a stationary tool component comprising a sloped surface,
wherein the sloped surface of the energizing end directly engages with the sloped surface of the energizing sleeve, wherein the perpendicular surface of the energizing end engages with the perpendicular surface of the energizing sleeve, and wherein after the engagement of the perpendicular surfaces, the sealing element is energized to create a seal via the engagement surface,
wherein the sloped surface of the stationary end directly engages with the sloped surface of the stationary tool component, and
wherein the sloped surface of the stationary tool component is located radially outside of the sloped surface of the stationary end.

2. The sealing assembly according to claim 1, wherein the sloped surface or the sloped surface and the perpendicular surface of the stationary end of the sealing element abuts the stationary tool component.

3. The sealing assembly according to claim 2, wherein the stationary tool component prevents movement of the stationary end of the sealing element during setting.

4. The sealing assembly according to claim 3, wherein the stationary tool component is a stationary sleeve or mule shoe.

5. The sealing assembly according to claim 1, wherein the sloped surface and the perpendicular surface of the energizing end forms an angle.

6. The sealing assembly according to claim 5, wherein the angle is in the range of 100° to 160°.

7. The sealing assembly according to claim 5, wherein the angle is in the range of 200° to 280°.

8. The sealing assembly according to claim 5, wherein the sloped surface of the energizing sleeve matches the angle.

9. The sealing assembly according to claim 1, wherein the sloped surface and the perpendicular surface of the stationary end forms an angle.

10. The sealing assembly according to claim 9, wherein the angle is in the range from 100° to 160°.

11. The sealing assembly according to claim 1, further comprising a set of support shoes located partially or wholly along the perpendicular surface of the energizing end and the perpendicular surface of the stationary end.

12. The sealing assembly according to claim 1, wherein the sealing assembly is part of a packer assembly or an anchoring device.

13. The sealing assembly according to claim 1, wherein the energizing sleeve further comprises one or more lock rings that lock within one or more lock ring grooves located on a mandrel or tool housing.

14. The sealing assembly according to claim 1, wherein the energizing sleeve further comprises ratchets that engage with ratchets located on a mandrel or tool housing.

15. The sealing assembly according to claim 1, wherein the sealing element is made from elastomers, rubbers, nitrile rubbers, or fluoroelastomers.

16. The sealing assembly according to claim 1, wherein the sloped surface of the energizing sleeve is located radially outside of the sloped surface of the energizing end.

17. A method of creating a seal in a wellbore comprising:

positioning a downhole tool at a location within the wellbore, the downhole tool comprising:

an inner mandrel;

an energizing sleeve comprising a sloped surface and a perpendicular surface;

a stationary tool component comprising a sloped surface; and only one sealing element located circumferentially around the inner mandrel, wherein the sealing element comprises:

an energizing end comprising a sloped surface and a perpendicular surface, wherein the sloped surface is located radially inside of the perpendicular surface;

a stationary end comprising a sloped surface and a perpendicular surface, wherein the sloped surface of the stationary tool component is located radially outside of the sloped surface of the stationary end and directly engages with the sloped surface of the stationary end; and an engagement surface located between the energizing end and the stationary end; and causing or allowing the sloped surface of the energizing sleeve to directly engage with the sloped surface of the energizing end and the perpendicular surface of the energizing sleeve to engage with the perpendicular surface of the energizing end, wherein after engagement, the engagement surface of the sealing element moves radially away from the inner mandrel to create the seal in the wellbore.

18. The method according to claim 17, wherein the engagement surface creates the seal between an outside of the inner mandrel and an inside of a casing string or tubing string.

19. The method according to claim 17, wherein the sloped surface of the energizing sleeve is located radially outside of the sloped surface of the energizing end.

* * * * *